United States Patent [19]

Kelly

[11] Patent Number: 4,969,519

[45] Date of Patent: Nov. 13, 1990

[54] SUBSEA HANGER AND RUNNING TOOL

[75] Inventor: Thomas P. Kelly, Houston, Tex.

[73] Assignee: Cooper Industries, Inc., Houston, Tex.

[21] Appl. No.: 373,089

[22] Filed: Jun. 28, 1989

[51] Int. Cl.[5] ..... E21B 33/043

[52] U.S. Cl. ..... 166/348; 166/208; 285/86; 285/141

[58] Field of Search ..... 166/348, 208, 125; 285/141-143, 2, 18, 82, 83, 86, 91, 3

[56] References Cited

U.S. PATENT DOCUMENTS

| | | | |
|---|---|---|---|
| 3,543,847 | 12/1970 | Haeber | 166/348 |
| 3,693,714 | 9/1972 | Baugh | 166/75 |
| 4,067,062 | 1/1978 | Baugh | 166/208 |
| 4,067,388 | 1/1978 | Mouret et al. | 166/208 |
| 4,262,748 | 4/1981 | Kirkland | 166/348 |
| 4,712,621 | 12/1987 | Wightman et al. | 166/348 |
| 4,712,621 | 12/1987 | Wightman et al. | 166/382 |
| 4,736,799 | 4/1988 | Ahlstone | 166/348 |

*Primary Examiner*—Bruce M. Kisliuk
*Assistant Examiner*—George Manuel

[57] ABSTRACT

An improved subsea tubing hanger having a body with an external shoulder for landing on a seat within a subsea wellhead housing, locking means carried by the hanger to engage the housing to lock the hanger in landed position, which locking means includes a locking element, actuator for setting the locking element and a securing pin for holding the actuating means in its locked position but being releasable responsive to sufficient upward force to sever the securing pin. The improved running tool includes a body with hydraulic actuated latching means for engaging the tubing hanger and which maintains its engagement with the tubing hanger even when hydraulic pressure is lost. The actuator includes an area exposed to hydrostatic riser pressure with sufficient area to retain the actuator in latched position even through the remainder of the actuating means is exposed to well bore hydrostatic head urging it out of latched position.

5 Claims, 14 Drawing Sheets

SUBSEA HANGER AND RUNNING TOOL

BACKGROUND

The present invention relates to an improved tubing hanger and running tool which overcomes the disadvantages of the prior subsea hanger running tools.

Running tools are typically designed to support the weight of a tubing hanger and its associated tubing string during tubing installation on a subsea well completion. In prior devices which are hydraulically operated, difficulties are encountered through a loss of the hydraulic system. This is particularly true since the hydrostatic fluid pressure is very substantial in subsea environments and can exert very substantial pressures on the exposed piston surfaces of the running tool. Some prior running tools were provided with a separate umbilical to ensure that the desired hydraulic pressure could be maintained to avoid the pressure responsive latching means from responding to the substantial hydrostatic pressures encountered at the subsea location. Since it is desired to maintain the running tool in latched engagement with the hanger after the hanger is landed until downhole work is completed, the release of the running tool from the hanger should be possible even when hydraulic latch pressure is lost prior to release. Some prior tools have solved this problem by closing a blowout preventer on the running tool string and then applying pressure through the choke or kill line of the BOP stack. This pressure surrounds the running tool and will cause the latch actuating sleeve of the running tool to retract to its unlatched position allowing retrieval of the running tool.

It is also possible with prior devices that as a result of needing to maintain the hydraulic latch pressure to resist the action of the hydrostatic pressure, the loss of the hydraulic latch pressure during the running of the tubing can result in the unlatching of the running tool. A further disadvantage of those prior tools which have separate umbilicals to the surface is that the umbilical control line is at risk during the lowering from the surface.

U.S. Pat. No. 3,693,714 discloses a tubing hanger with a running tool which uses pressure of hydraulic fluid delivered through the running string and relies on either a locking dart to direct the hydraulic pressure to urge the locking sleeve in the locked direction and an unlocking dart to direct the hydraulic pressure to urge the locking sleeve in the unlocked direction.

U.S. Pat. No. 4,262,748 discloses a hanger and running tool which is secured to the hanger by spring loaded segments and releasing ring on the hanger which on full seating of the hanger cams the segments out of engagement with the hanger to release the running tool therefrom.

U.S. Pat. No. 4,067,388 discloses a running tool and a casing hanger with a split latch ring having external threads which are engaged within the internal hanger threads and a piston ring which wedges the split latch ring into latching engagement with the hanger. Release is either by retraction of the piston ring or by rotation to thread the latch ring out of engagement with the hanger.

U.S. Pat. No. 4,712,621 discloses a casing hanger running tool which is moved between running, setting, releasing and dumping positions. Also, there is a hydraulic system to control a piston which moves latching dogs supporting the hanger on the running tool. Hydraulic fluid is delivered through the bore of the tool.

U.S. Pat. No. 4,736,799 discloses a running tool which is operated by hydraulic fluid delivered through control passages to lower, land, set seal and release from the hanger. A spool valve is provided in the hydraulic system to allow for failure in the release line.

SUMMARY

An improved subsea tubing hanger having a body with an external shoulder for landing on a seat within a subsea wellhead housing, locking means carried by the hanger to engage the housing to lock the hanger in landed position, with the locking means including a locking element, actuating means for setting the locking element and securing means for holding the actuating means in its locked position but being releasable responsive to sufficient upward force to sever the securing means. The improved tubing hanger running tool includes a body supporting a latching means which is hydraulically actuated for engaging a tubing hanger which maintains its latching engagement with the tubing hanger even when the hydraulic connection to the actuating means is lost with hydrostatic riser pressure being exerted on a portion of the actuating means over a larger area than the area which is exposed to the well bore hydrostatic head, a locking mechanism for securing the hanger within the wellhead housing and an emergency latch release available to allow release of the tool from the hanger by the simple expedient of closing the blowout preventer and pressuring the well bore below the blowout preventer to provide a release of the latching of the tool to the hanger.

An object of the present invention is to provide an improved tool for lowering, landing and locking a hanger through a riser to a position within a subsea wellhead housing which remains latched to the hanger despite the loss of hydraulic fluid to the latching side of the actuating means.

Another object of the present invention is to provide an improved running tool for a hanger to be lowered through a riser to a position within a subsea wellhead which can be unlatched from the hanger through an emergency system independent of the hydraulic actuator for the latching mechanism.

Still another object is to provide an improved hanger and running tool for lowering the hanger through a riser to a position within a subsea wellhead housing in which engagement between the hanger and tool is maintained even through hydraulic communication to the latching actuator is lost and can be unlatched without the use of such hydraulic communication.

BRIEF DESCRIPTION OF THE DRAWINGS

These and other objects and advantages of the present invention are hereinafter set forth and explained with reference to wherein.

DESCRIPTION OF THE PREFERRED EMBODIMENT

Figure 1:
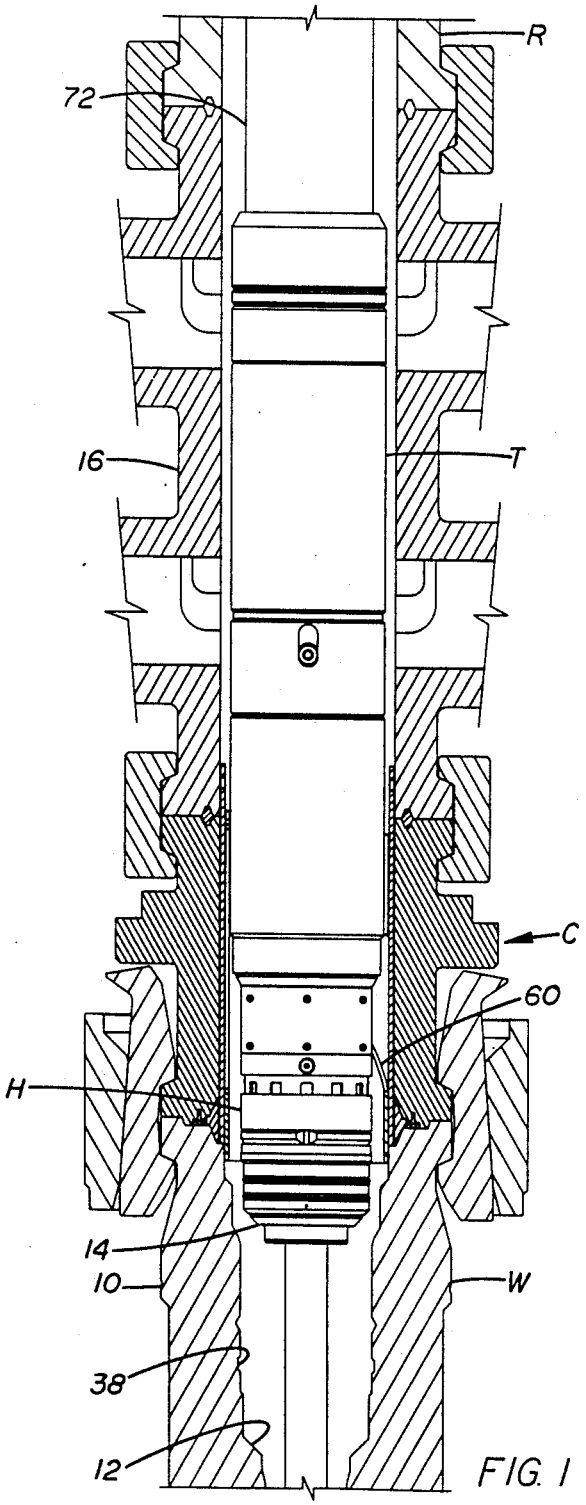
FIG. 1 is a sectional view of a subsea wellhead with the improved running tool and hanger of the present invention being run therein, the running tool and hanger being shown in elevation.

As shown in FIG. 1, subsea tubing hanger H is supported from running tool T and being lowered through riser R into the interior of subsea wellhead W. Wellhead W includes wellhead housing 10 having internal landing seat 12 therein for receiving shoulder 14 of hanger H, blowout preventer stack 16 secured above housing 10 by collet connector C and riser R secured above blowout preventer stack 16. Riser R extends to a suitable structure (not shown) at the surface for the drilling and other operation within wellhead W. Running tool T is suitably latched to hanger H and is lowered as shown into position for landing on shoulder 14. When landed as herein after described, hanger H is locked in its landed position and running tool T is left in engagement therewith until it is to be withdrawn.

Figure 2A:
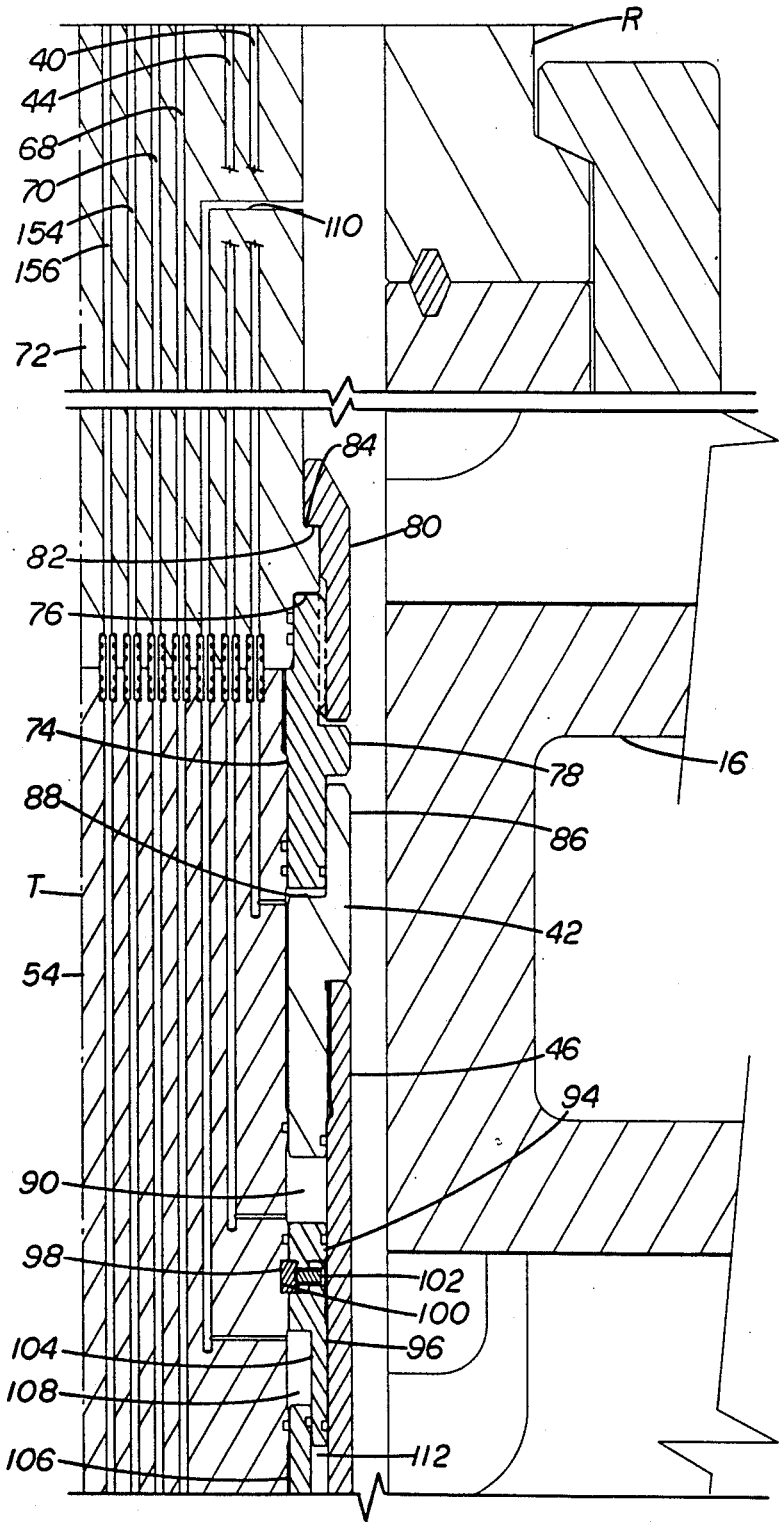
FIG. 2A, 2B and 2C quarter sectional views of the improved running tool and hanger being lowered in the subsea wellhead prior to landing therein with FIG. 2A being the upper portion, FIG. 2B being the intermediate portion and FIG. 2C being the lower portion thereof.
Figure 2B:
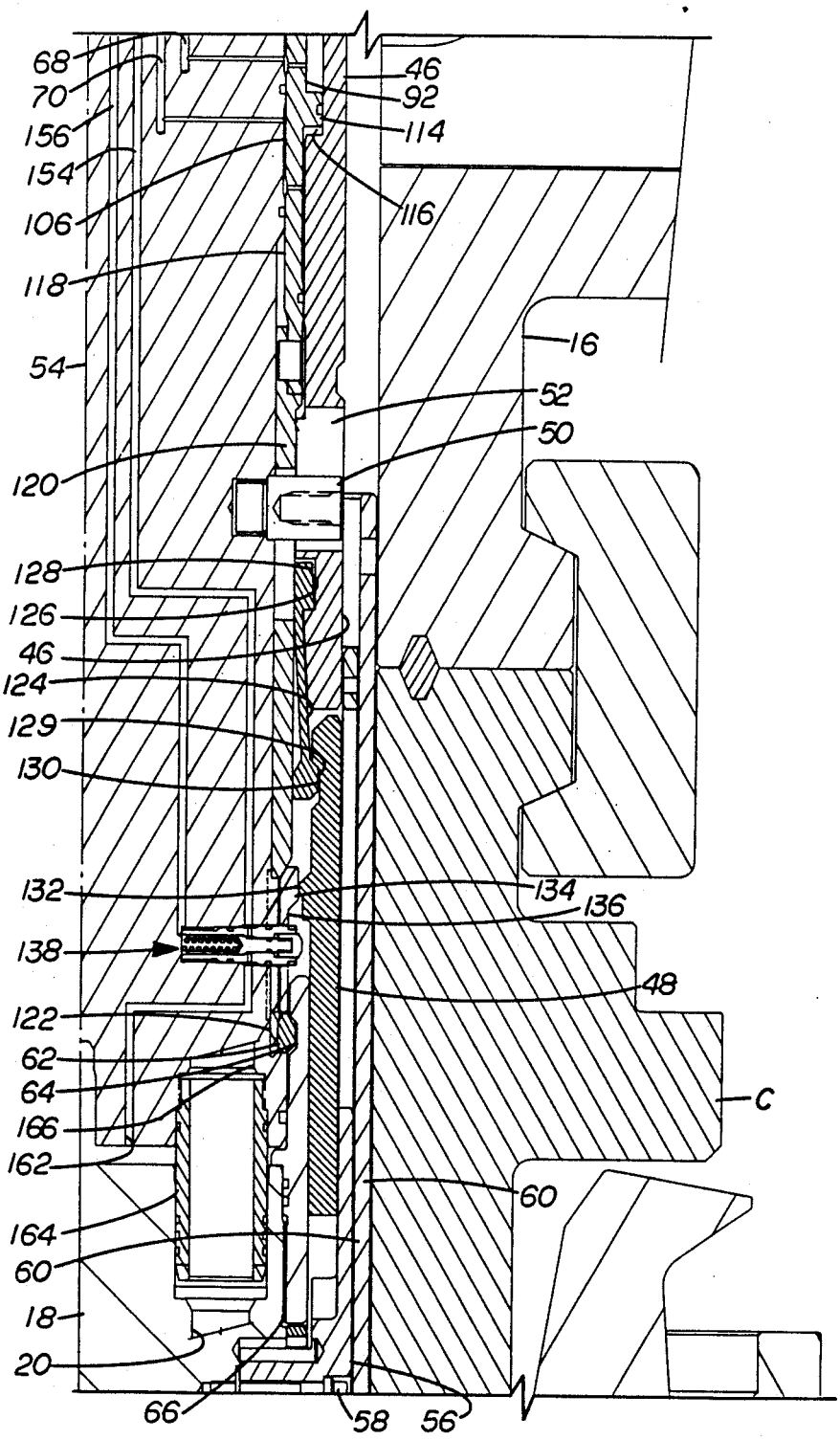
Figure 2C:
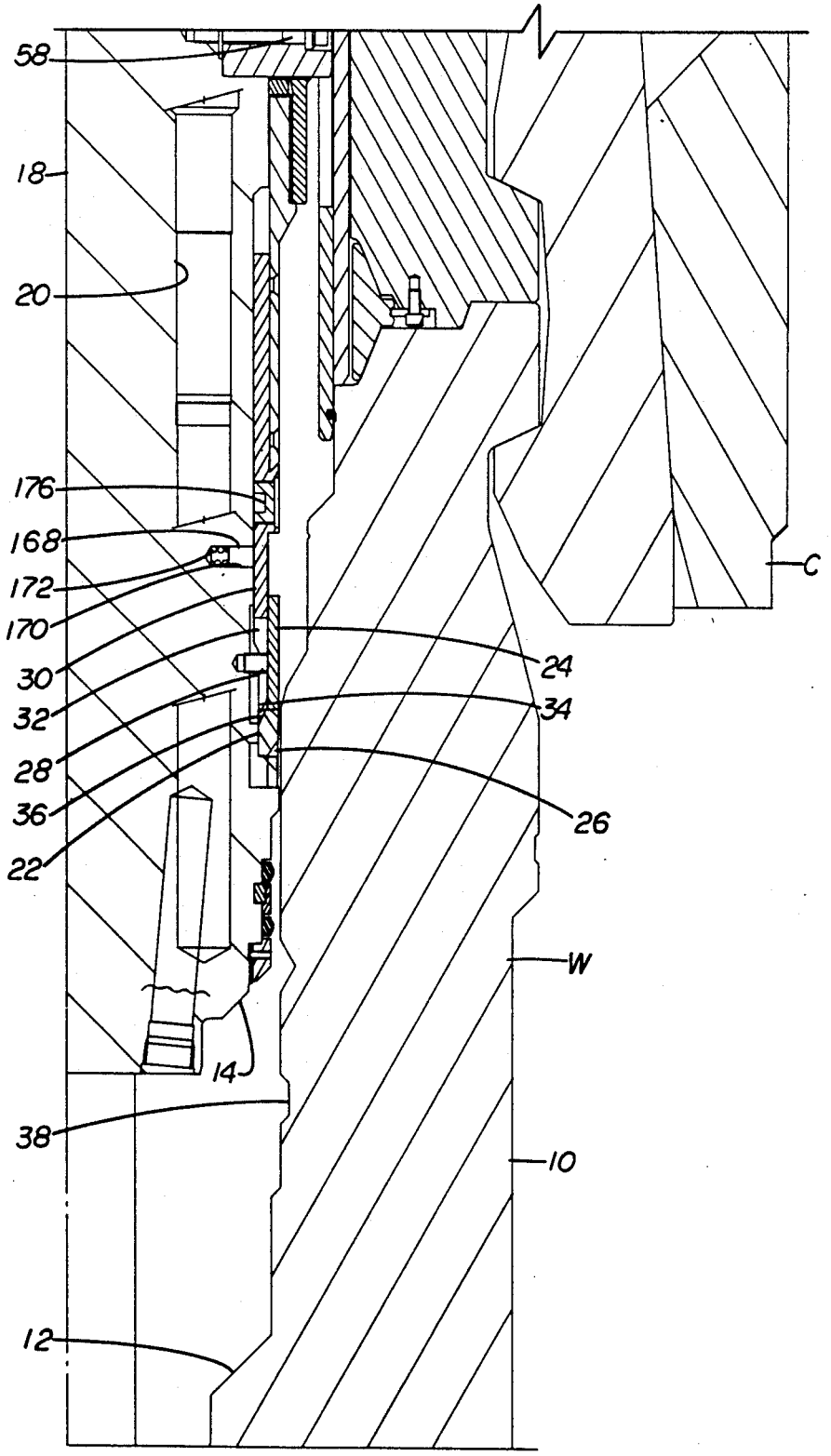

Running tool T and hanger H are shown in FIGS. 2A, 2B and 2C as quarter sectional views. The sectional views of hanger H and running tool T in FIGS. 2 through 5 are distorted sectional views to show the hydraulic passages as though they were radially positioned but they are suitably positioned in tool T and hanger H both radially and circumferentially to accommodate their function and coaction.

Hanger H includes body 18 having suitable passages 20 with only one of such passages being shown and external landing shoulder 14 which is sized to allow hanger H to land and be seated on internal landing seat 12 within wellhead housing W. Locking ring 22 is positioned in surrounding relationship to the lower portion of hanger body 18 at a position spaced above landing shoulder 14. Sleeve 24, which is secured to body 18, defines an annular slot 26 in which split locking ring 22 is positioned and is secured to body 18 by suitable means, such as set screws 28. Lock actuating sleeve 30 is positioned in surrounding and slidable relationship around body 18 and within sleeve 24. Actuating sleeve 30 includes slots 32 through which cap screws 28 extend to allow axial movement of sleeve 30 with respect to body 18, sleeve 30 and locking ring 22. The lower end of actuating sleeve 30 includes taper 34 which coacts with the upper interior surface 36 of locking ring 22 so that downward movement of actuating sleeve 30 moves its taper 34 under locking ring 22 and wedges locking ring 22 radially outward into locking engagement within annular locking recess 38 in the interior of housing 10 to lock hanger H therein.

The locking of hanger H into housing 10 is responsive to pressure delivered through passage 40 to the upper side of lock piston 42 while pressure from the lower side of lock piston 42 is vented through passage 44. Lock sleeve 46 is threaded onto lock piston 42 and extends downwardly so that its lower end engages hanger lock sleeve 48. Orienting pins 50 are positioned in slots 52 and engage within tool body 54. Orienting key 56 is secured to hanger body 18 by screw 58 and is adapted to coact with orienting sleeve 60 which is positioned within well housing 10 to ensure that the proper location of well components lowered therein are duplicated so that the tubing connections will be properly aligned with passages 20. Lock piston 42 is suitably connected to actuating sleeve 30 as hereinafter described to ensure proper locking of hanger H within housing 10 when it has been properly landed therein.

During running of hanger H as shown in FIGS. 1, 2A, 2B and 2C, tool T is securely engaged to hanger H. This engagement is provided by the engagement of split latch ring 62 within internal latching groove 64 on the interior of hanger sleeve 66. This latching is done at the surface and is accomplished by supplying hydraulic pressure to latch passage 68 and venting unlatch passage 70 which passages extend through tool body 54 and are provided with suitable connections to the surface through running string 72 while string 72 is connected to the upper end of tool body 54. The connecting means for making this connection include ring 74 which includes a bore so that it fits around the upper exterior of tool body 54 and is threaded thereon with its upper end being in engagement with downwardly facing shoulder 76. Flange 78 extends outwardly from the central portion of the exterior of ring 74 and suitable seals are provided to seal against the exteriors of string 72 and tool body 54. Lock nut 80 is threaded on the upper exterior of ring 74 and has its inner downwardly facing shoulder 82 in engagement with external upwardly facing shoulder 84 on the exterior of string 72 to secure this connection. Suitable seal is provided around the lower exterior of ring 74 for sealing against the interior of upper rim 86 of lock piston 42. This structure provides the upper lock chamber 88 to which passage 40 communicates and unlock chamber 90 to which passage 44 communicates. Thus, pressure through passage 40 causes lock piston 42 to be moved downwardly and pressure through passage 44 causes lock piston 42 to be moved upwardly.

Latch piston 92 is positioned below upper stop ring 94 which forms the lower end of unlock chamber 90 and lower stop ring 96 with split ring 98 engaging in external groove 100 in the exterior of tool body 54 and screws 102 extending through the upper portion of lower stop ring 96 to secure ring 98 in groove 100 and to secure lower stop ring 96 in position immediately below upper ring 94. Lower stop ring 96 includes lower outer rim 104 which is spaced outward from the exterior of tool body 54 and receives upper rim 106 of latch piston 92 with chamber 108 which is vented to the interior of riser R through passage 110 so that on closing of either of the ram-type blowout preventers of blowout preventer stack 16 internal riser pressure is above the closed preventer is communicated to chamber 108.

Latch chamber 112 is formed above the seals in the exterior of latch piston flange 114 and between the seals against the interior of latch piston 92 between passages 68 and 70. Unlatch chamber 116 is formed below the seal in the exterior of latch piston flange 114 and above the seals engaging lower piston rim 118. The effective pressure area of riser vent chamber 108 is larger than the effective pressure area of the lower portion of latch piston rim 118 below the inner and outer seals. Since the annulus pressure from below hanger may be exerted on this lower piston rim area, the larger pressure induced force of riser vent chamber 108 allows the lowering of tool T with hanger H thereon without the necessity of maintaining latching pressure on latch chamber 112. This is a very substantial advantage since it is possible to lose communication to the hydraulic passages in tool T during operations and as with prior tool such loss could act to unlatch the engagement between the tool and hanger, the prevention of this unlatching avoids problems which could arise if there were an unlatching of the engagement.

During the latching movement of piston 92, piston 92 moves downward and through its connection to sleeve 120 causes the lower end of sleeve 120 which functions as latch actuator 122 to be moved downwardly under latch ring 62 causing it to be wedged outwardly into latching engagement within internal latching groove 64. This secures tool T to hanger H. Unlatching is accomplished by supplying hydraulic fluid to unlatch chamber 116 through passage 70 and with latch chamber 112 being vented through passage 68. This moves latch piston 92 upwardly causing latch actuator 122 to be raised and moved out from within latch ring 62 so that latch ring 62 contracts inwardly out of engagement with internal latching groove 64 to cause tool T to be unlatched from hanger H.

Figure 2D:
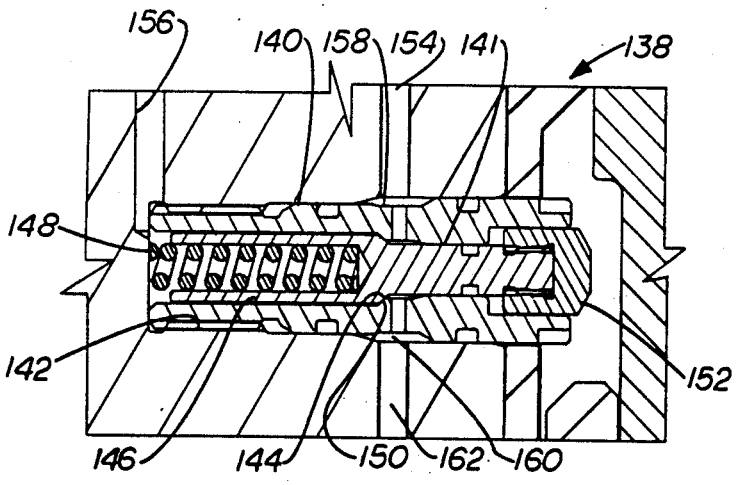
FIG. 2D is an enlarged sectional view of the lock test cartridge positioned within the running tool.
Figure 3A:
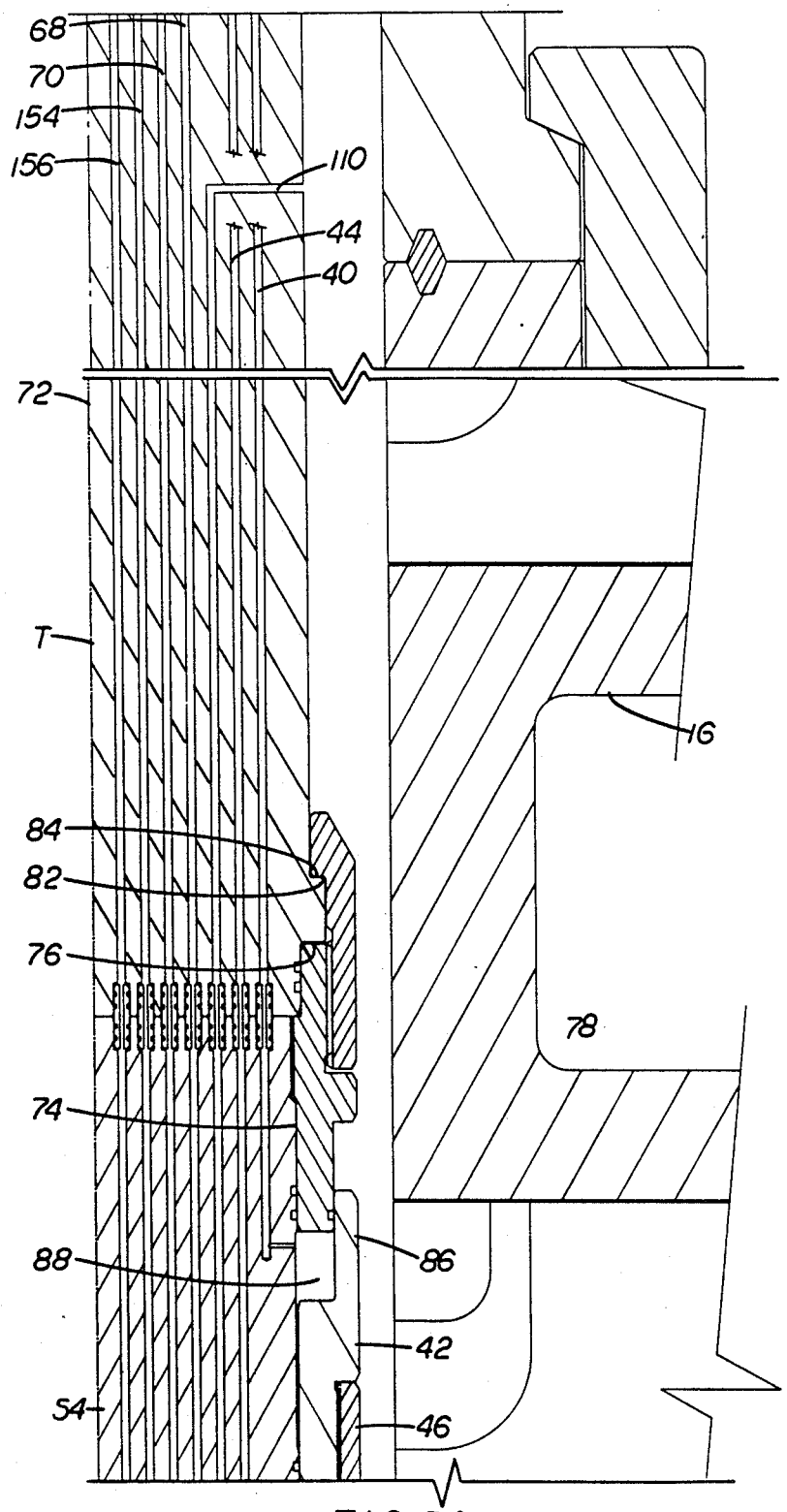
FIGS. 3A, 3B and 3C are the upper, intermediate and lower portions of the quarter sectional view of the running tool and hanger landed and locked within the wellhead.
Figure 3B:
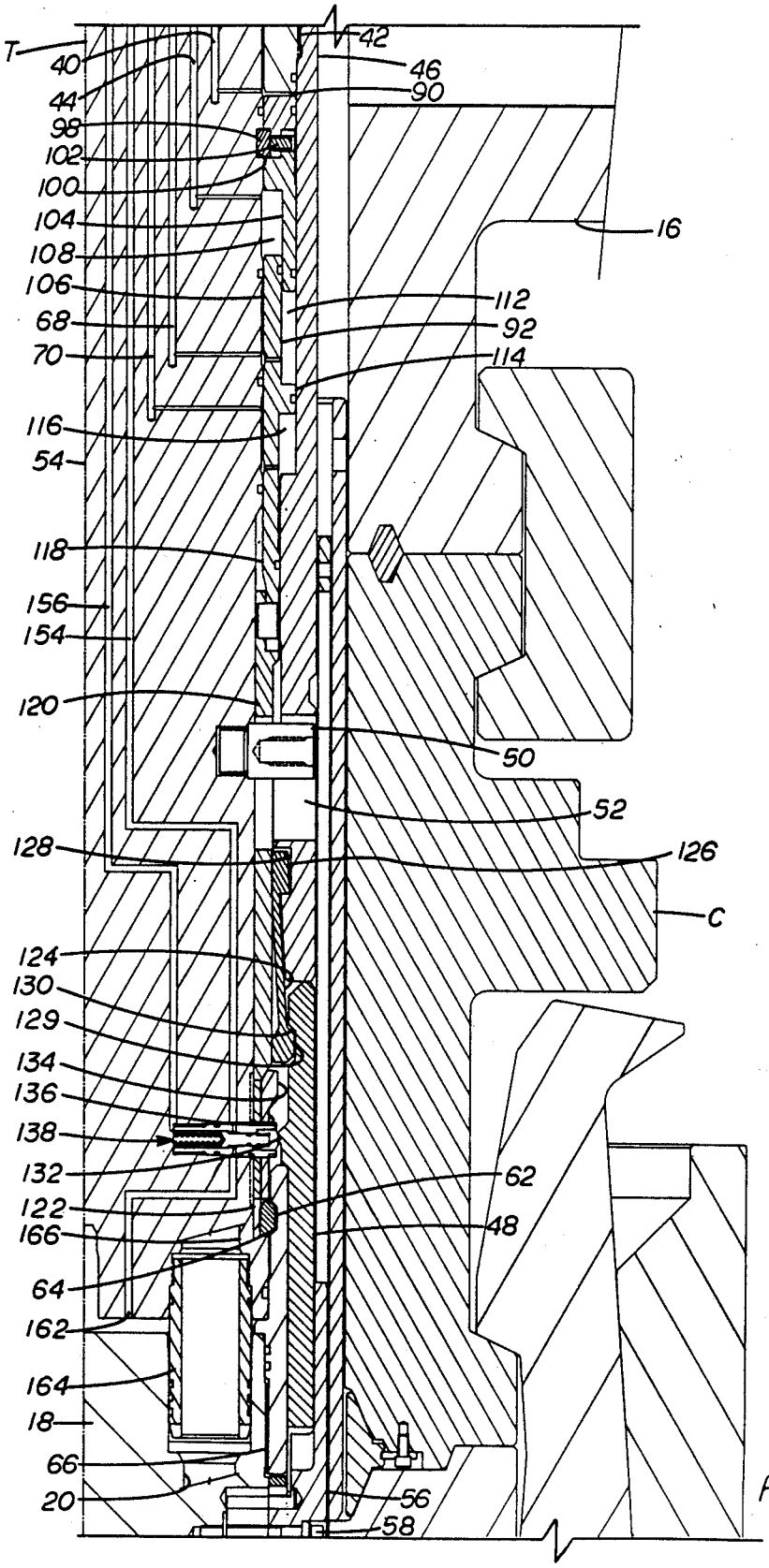
Figure 3C:
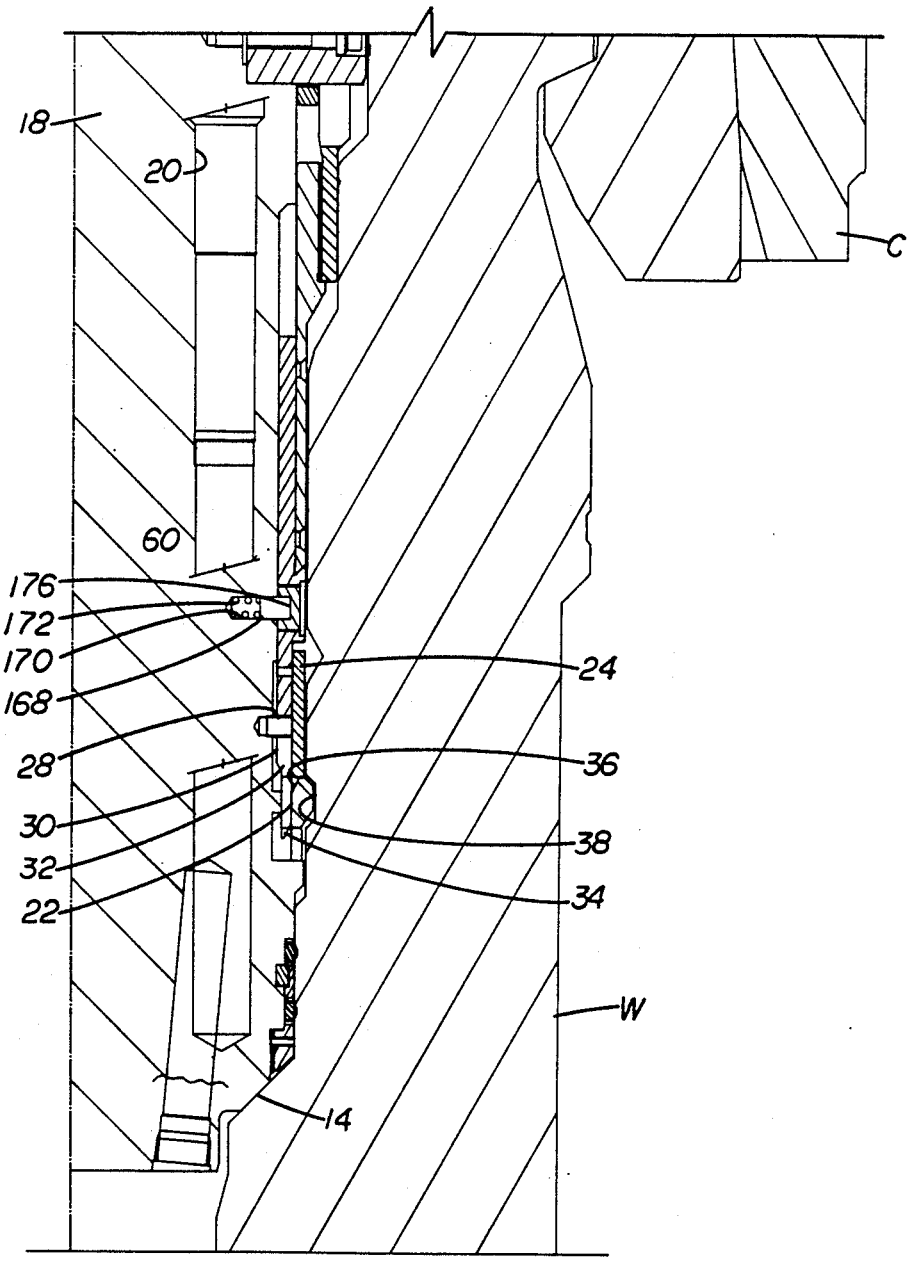

Lock sleeve 46 is connected to hanger lock sleeve 48 by dogs 124 which have an upper enlargement 126 engaged within recess 128 on the interior of lock sleeve 46 and lower enlargement 129 engaged within recess 130 on the interior of hanger lock sleeve 48. The interior of hanger lock sleeve 48 also includes internal projection 132 below recess 130 which in the running position is engagement with projection 134 on the exterior of guard ring 136 which is secured by cartridge valve 138 to tool body 54. Cartridge valve 138, as best seen in FIG. 2D, is secured within tool body 54 and is positioned to be aligned with internal projection 132 when hanger locking means has been set to locked position with lock ring 22 secured within recess 38. Cartridge valve 138 includes body 140 which is threaded within recess 142 in tool body 54 with an internal inwardly facing seat 144 to coact with valve member 146 positioned within body 142 and biased outwardly by spring 148 to have external shoulder 150 in engagement with seat 144 to prevent flow therethrough. The outer portion of valve member 146 includes cap 152 which is adapted to engage projection 132 when locking has been completed. Passage 156 communicates through tool body 54 to the inner end of recess 142. Passage 154 communicates through tool body 54 with recess 142 at a position above seat 144. Body 140 includes external groove 158 in communication with passage 154 and by-pass 160 extending through body to communicate with passage 162 which extends to the lower end of tool body 54.

With hanger H and tool T assembled as shown in FIGS. 1, 2A, 2B and 2C, the assembly is lowered into the wellhead W as shown. Key 56 will engage the mule shoe or helical taper in orienting sleeve 60 to cause hanger H and tool T to rotate to the desired orientation and then further downward movement causes hanger shoulder 14 to come into engagement with landing seat 12 within housing 10. With landing determined, hydraulic pressure is supplied through lock passage 40 and passage 44 is vented. This causes lock piston 42 to be moved downwardly, which moves lock sleeve 46, hanger lock sleeve 48 and actuating sleeve 30 to also move downwardly. This moves the lower tapered end of actuating sleeve 30 within lock ring 22 to force it outwardly into locking engagement within recess 38 on the interior of housing 10 to function as the locking means locking hanger H within housing 10. In this position any operations which need to be conducted may be completed without fear of unlatching the engagement of tool T from hanger H even though such operations may result in the interruption of the delivery of hydraulic pressure through passage 68 to latch chamber 112. This is because riser vent chamber 108 has a larger effective pressure area than effective pressure on the lower portion of latch piston 92. This latched and locked position of the assembly is clearly illustrated in FIGS. 3A, 3B and 3C.

It should be noted that the supplying of pressure through lock test passage 156 will provide an indication of the successful locking of the locking means within housing 10. This is indicated by an increase flow in the return of fluid through vent passage 154. Further, the depletion of fluid pressure in passage 156 could be used as a further indication of the successful locking which positively indicates that projection 132 on the interior of hanger sleeve 48 has moved downwardly and engaged cap 152 of lock test cartridge valve 138 to unseat valve member 146 from engagement with seat 144, thus providing communication through cartridge valve 138 between passages 156 and 154.

When such operations are complete and it is desired to retrieve tool T, hydraulic pressure is supplied through unlatch passage 70 and latch passage 68 is vented. This causes latch piston 92 to move upwardly resulting in the upward movement of latch actuator 120 to allow latch ring 62 to withdraw inward out of engagement with latching groove 64. This upward movement also allows lower enlargement 129 on dogs 124 to move inward onto the lower end of sleeve 120 and out of engagement with recess 130 on the interior of hanger lock sleeve 48. This completes the disengagement of tool T from hanger H and lifting on string 72 allows the recovery of tool T from within the wellhead W. It should be noted that if the hanger is to be retrieved for any reason, the locking can be reversed by reversing the pressure of the hydraulic fluid and cause the unlocking of the locking means. This allows the assembly to be retrieved. After replacement of the shear pins 168 it can be run and locked.

Tubing element 164 is positioned in the tubing string passage 166 within the lower end of tool body 54 and also within passage 20 in the upper end of hanger body 18. Suitable seals are provided around the exterior of tubing element 164 and its inner diameter is substantially the same as the diameter of passages 166 and 20 so that there is no appreciable restriction of the tubing string in passing through tool T and hanger H.

Figure 4A:
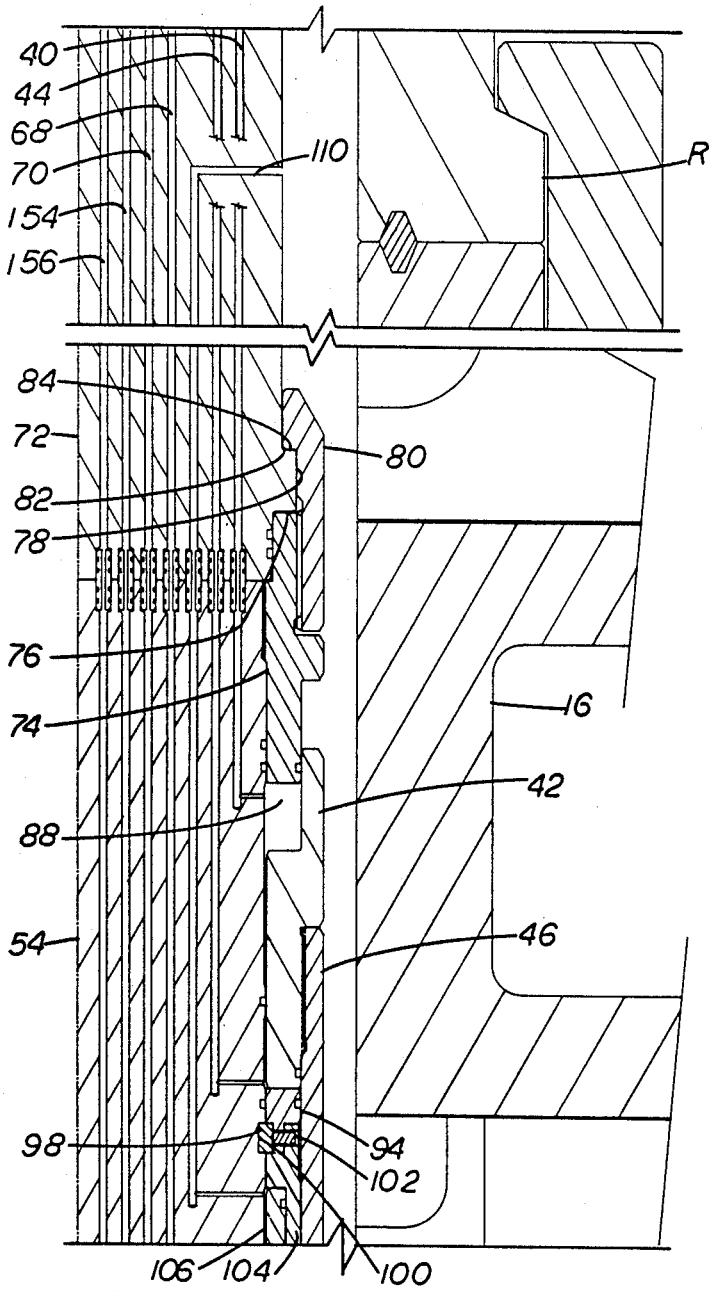
FIGS. 4A, 4B and 4C are the upper, intermediate and lower portions of the quarter sectional view of the running tool and hanger showing the hanger locked in its landed position within the wellhead and the running tool released therefrom and being retrieved.
Figure 4B:
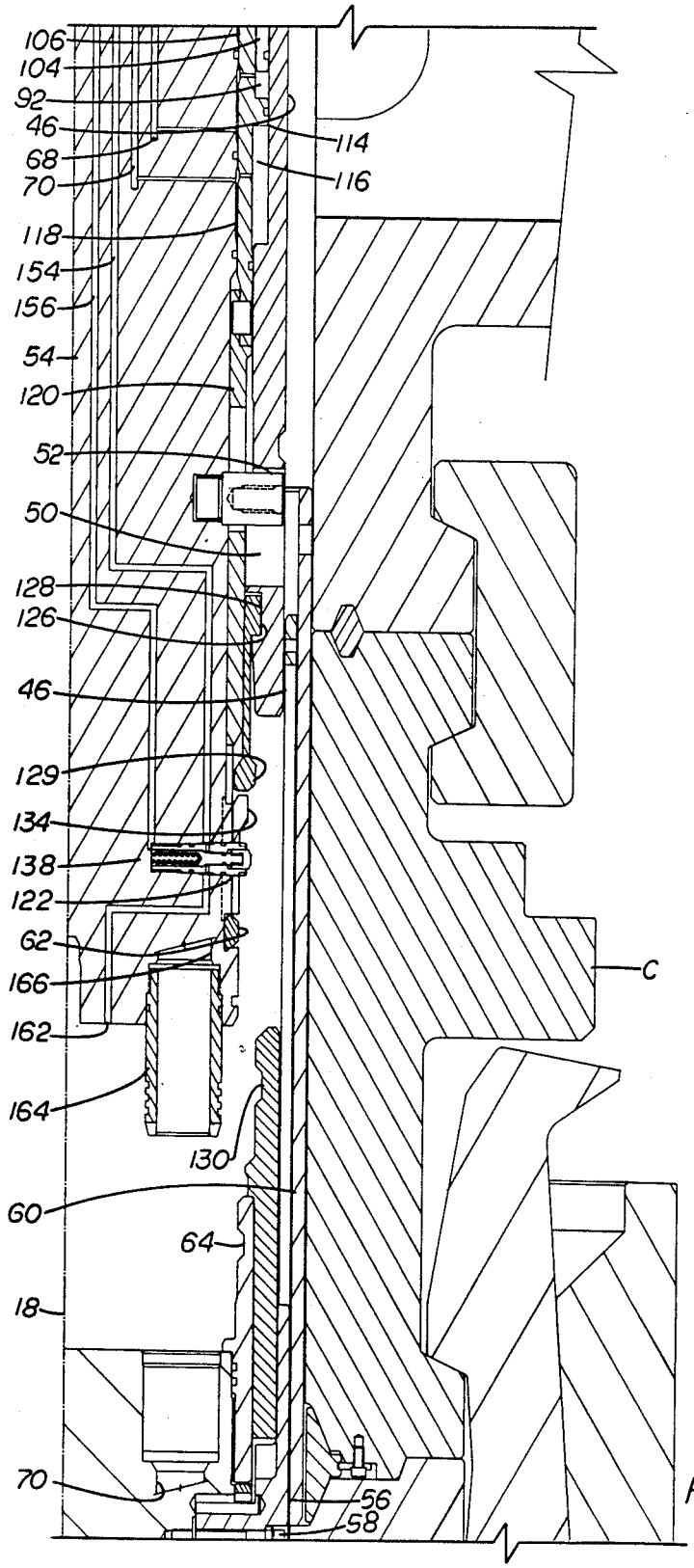
Figure 4C:
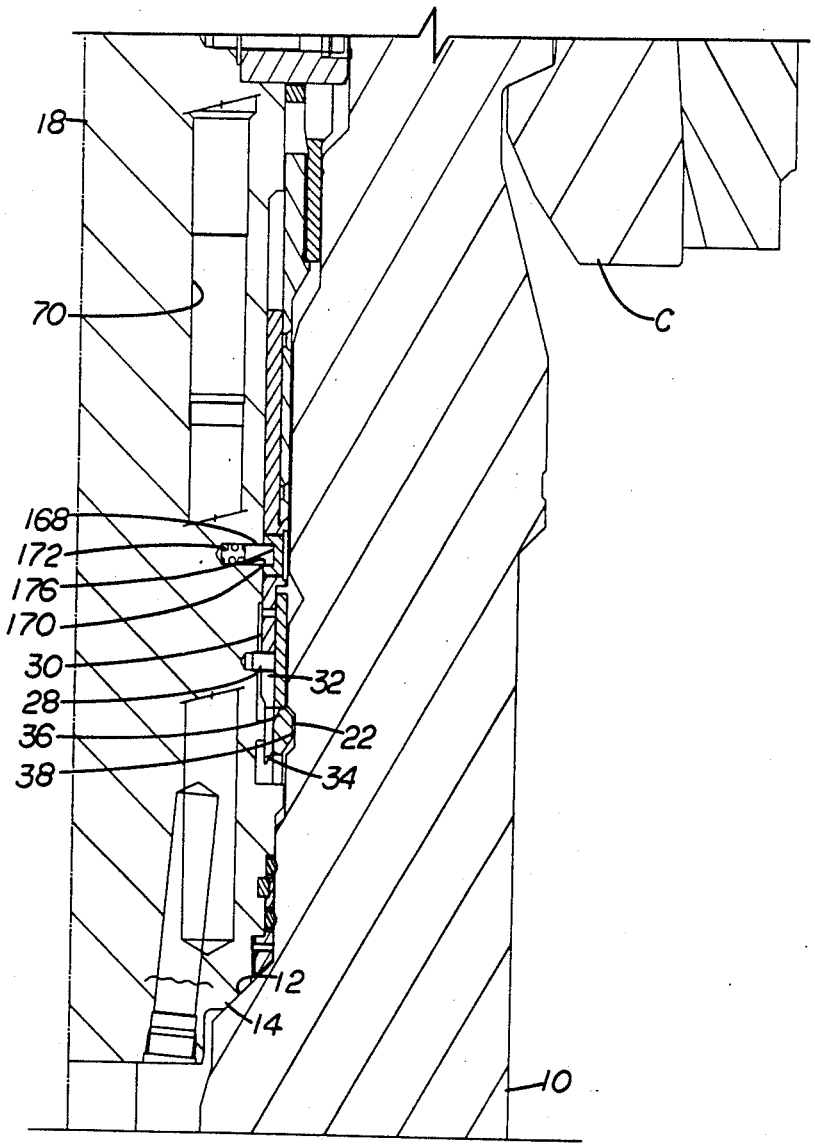
Figure 5A:
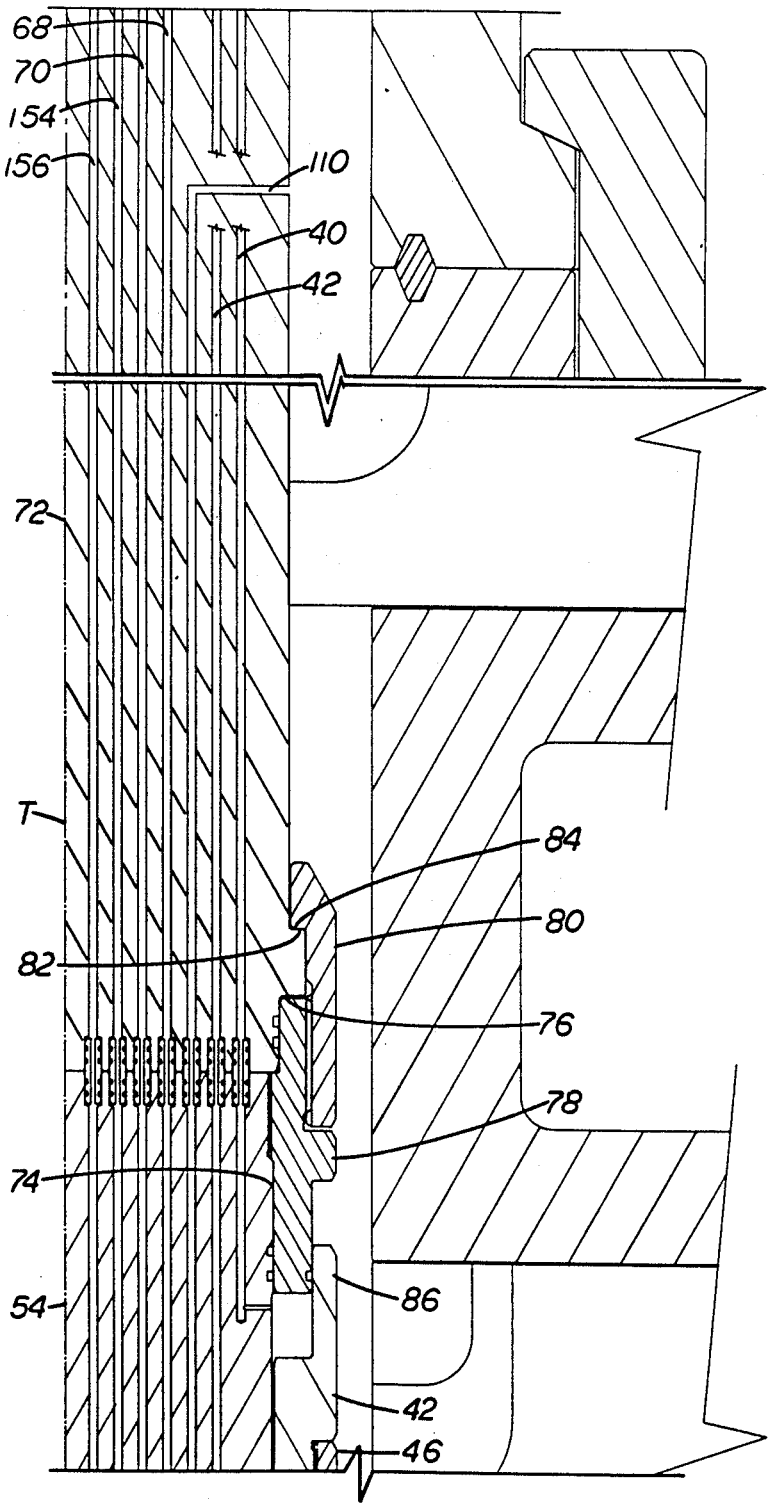
FIG. 5A, 5B and 5C are the upper, intermediate and lower portions of the quarter sectional view of the running tool, hanger and wellhead showing the hanger locked in its landed position within the wellhead and the running tool emergency release being activated.
Figure 5B:
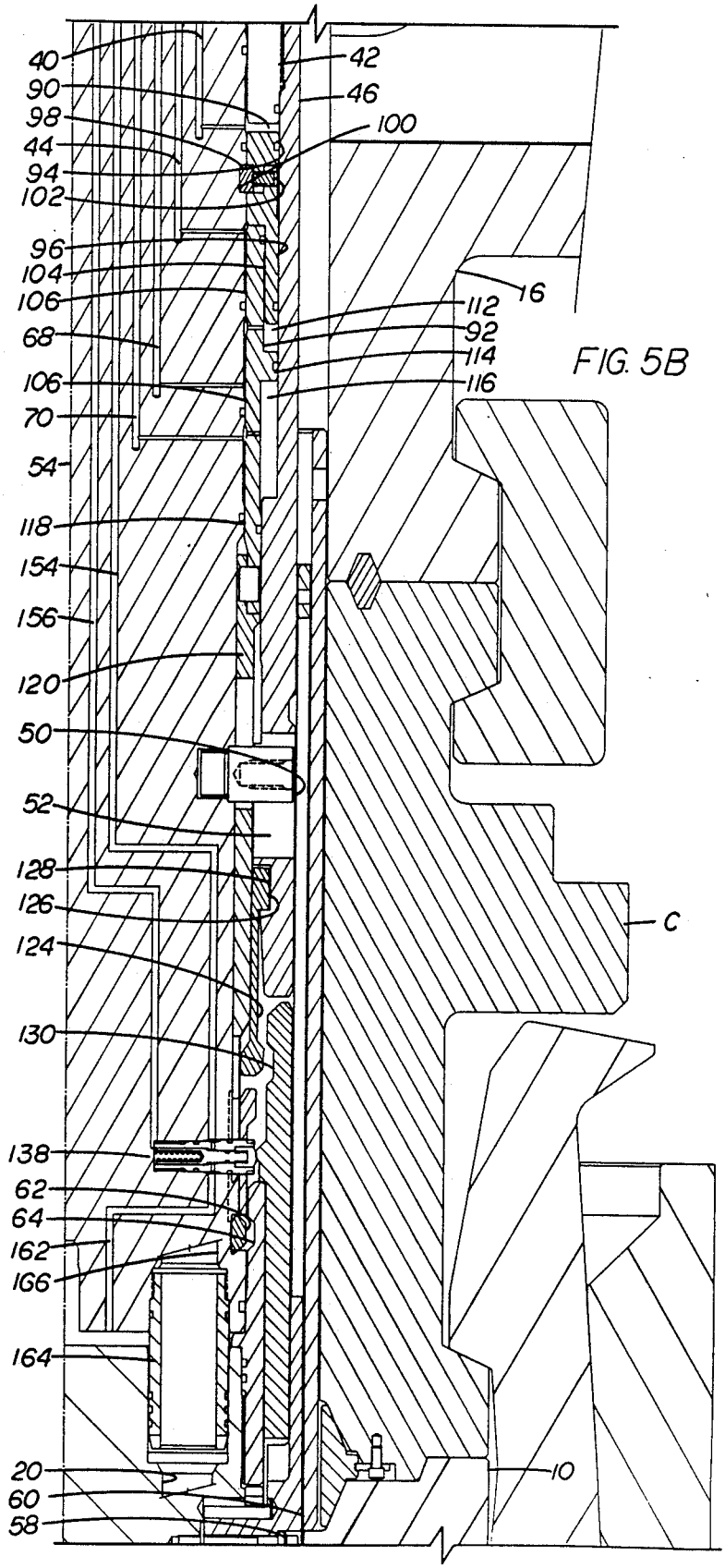
Figure 5C:
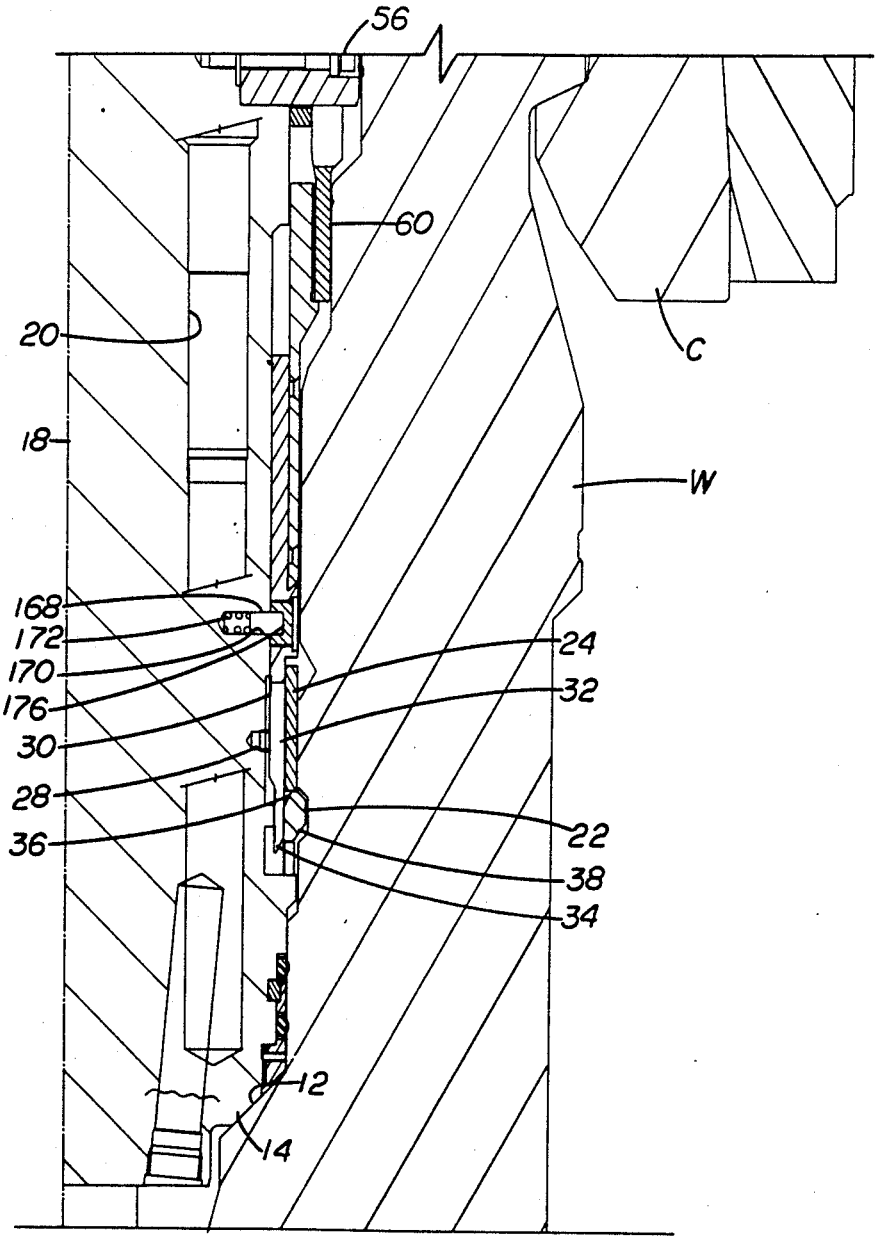

The normal unlatching and recovery of tool T from hanger H is illustrated in FIGS. 4A, 4B and 4C and the emergency unlocking of hanger H from housing 10 is illustrated in FIGS. 5A, 5B and 5C. An alternate mechanical unlocking of hanger H is provided by a separate tool (not shown) which exerts sufficient pull on a string carrying the tool which engages hanger H to sever shear pins 168. Shear pins 168 are normally held within recesses 170 on the exterior of hanger body 18 and are biased outwardly by springs 172. During all operations pins 168 are held within recesses 170 by engagement with the inner surface of actuating sleeve 30. Actuating sleeve 30 includes inserts 174 each having an inwardly facing recess 176 of sufficient size to receive the outer end of one of pins 168 and positioned to allow pins 168 to move therein when sleeve 30 has moved to its lowermost or locked position. Conversely, once hanger H has been properly locked to housing 10, it may be release by exerting sufficient tension on the string 72 to shear pins 168. Upon shearing of pins 168, actuating sleeve 30 can then be moved upwardly by the lifting and this unlocks the locking means by cause locking ring 22 to withdraw from its engagement within recess 38. The emergency unlocking and recovery of hanger H may be utilized while tool T is still latched to hanger H or it may be utilized when tool T is rerun and latched into hanger H. On the rerunning of tool T it is suggested that suitable orienting means (not shown) be provided and such means can be secured to tool T by screws engaging within orienting pins 50.

What is claimed is:

1. A subsea wellhead comprising a wellhead housing having an internal landing seat and an internal locking recess, a hanger having a body with an external shoulder for landing on said housing internal landing seat, and locking means carried by said hanger for actuation to engage within said internal locking recess and thereby secure said hanger within said housing, said locking means including a locking element, actuating means mounted on said hanger body and being slidable thereon for movement with respect to said locking element to urge it outwardly into engagement within said internal locking recess, means for securing said actuating means in its locked position but held inactive until said actuating means reaches its locked position, said securing means being releasable responsive to an upward force on said hanger body which is sufficient to sever said securing means and release said actuating sleeve.

a running tool having a body and latching means to secure said running tool body to said hanger, said latching means being operable by hydraulic fluid pressure between latched and unlatched position, and said latching means including means for retaining it in the latched position during loss of hydraulic pressure.

2. A subsea wellhead according to claim 1 wherein said latching means includes, a latching element, a latching piston for setting said latching element and including a latching chamber, an unlatching chamber, a riser vent chamber and a lower chamber open to the wellhead hanger annulus, said riser vent chamber having a larger effective pressure area than the lower chamber whereby, pressure in said riser vent chamber urging said latching piston in the latching direction and annulus pressure urging said latching piston in the unlatching direction, whereby said riser vent chamber maintains said latching piston in latched position even though hydraulic pressure is lost to both said latching and unlatching chambers, and whereby pressure in said lower chamber urges said latching piston in the unlatching direction thereby allowing a selective unlatching of said latching means and releasing said running tool from said hanger.

3. A running tool for running a hanger into a subsea wellhead having a housing, a blowout preventer and a riser above the blowout preventer, comprising a tool body, a latching means including a latching element moved between latched and unlatched position with respect to the hanger by a latching piston, said latching piston include an upper chamber, an intermediate latching chamber, an unlatching chamber below said intermediate latching chamber and a lower chamber, means for communicating hydraulic pressure to said latching and said unlatching chambers, means providing communication to said upper chamber to the interior of the riser above the blowout preventer, said lower chamber being exposed to pressure from within the hanger-housing annulus, said upper chamber having a larger effective pressure area than said lower chamber so that said upper chamber maintains said piston in its latching position when it has been actuated to such position even though latching pressure is lost from said latching chamber.

4. A running tool according to claim 3 including means for locking the hanger within said housing, and means for testing to determine the completion of the locking of said hanger to said housing.

5. A running tool according to claim 4 wherein said testing means includes a cartridge valve secured within the hanger body and having an outer portion which is engaged by the locking means when locking is complete, said cartridge valve including a seat, a valve member biased to engage said seat, a first passage through said tool body communicating with said valve on one side of said seat and a second passage communicating with said valve on the opposite side of said seat, engagement of said outer portion causing said valve member to disengage from said seat to open communication between said first and second passages to allow an indication of the completion of the locking of the hanger within the housing.

* * * * *